US006561846B2

(12) United States Patent
D'Addario

(10) Patent No.: US 6,561,846 B2
(45) Date of Patent: May 13, 2003

(54) COUPLER FOR BANANA PLUG CONNECTORS AND COUPLED BANANA PLUG CONNECTORS

(75) Inventor: James D'Addario, Old Westbury, NY (US)

(73) Assignee: J. D'Addario & Co., Inc., Farmingdale, NY (US)

( * ) Notice: Subject to any disclaimer, the term of this patent is extended or adjusted under 35 U.S.C. 154(b) by 0 days.

(21) Appl. No.: 09/902,918

(22) Filed: Jul. 10, 2001

(65) Prior Publication Data

US 2003/0013350 A1 Jan. 16, 2003

(51) Int. Cl.[7] ..... H01R 13/60
(52) U.S. Cl. ..... 439/540.1
(58) Field of Search ..... 439/540.1, 825, 439/638, 652, 651, 622

(56) References Cited

U.S. PATENT DOCUMENTS

| | | | | | |
|---|---|---|---|---|---|
| 4,405,196 | A | | 9/1983 | Fulton | 339/273 F |
| D281,681 | S | | 12/1985 | Kaufman | D13/24 |
| 4,764,127 | A | * | 8/1988 | Price | 439/551 |
| 4,824,405 | A | | 4/1989 | Derain | 439/807 |
| 4,937,401 | A | * | 6/1990 | Lee | 174/117 F |
| D347,208 | S | | 5/1994 | Martin et al. | D13/133 |
| 5,318,458 | A | | 6/1994 | Thorner | 439/427 |
| 5,470,239 | A | | 11/1995 | Rancourt | 439/105 |
| 5,614,688 | A | | 3/1997 | Donnell | 84/743 |
| 5,703,324 | A | | 12/1997 | Harder | 174/21 C |
| 5,791,919 | A | * | 8/1998 | Brisson et al. | 439/166 |
| 5,793,578 | A | | 8/1998 | Jones | 361/683 |
| 6,022,226 | A | | 2/2000 | Lyford et al. | 439/78 |

* cited by examiner

*Primary Examiner*—Gary Paumen
*Assistant Examiner*—Ann McCamey
(74) *Attorney, Agent, or Firm*—Gerald T. Bodner

(57) ABSTRACT

A coupler for use with at least two banana plug connectors includes two preferably cylindrical portions molded together as a flexible unit. Apertures in the cylindrical portions are able to receive protrusions extending from each of the banana plug connectors to form a frictional fit between the coupler and the connectors. The frictional fit retains the connectors together, which prevents accidental shorting of the connectors and enables the connectors to assume various rotational and/or linear relationships with respect to each other to accommodate different spacings and orientations of corresponding female connectors.

20 Claims, 7 Drawing Sheets

COUPLER FOR BANANA PLUG CONNECTORS AND COUPLED BANANA PLUG CONNECTORS

BACKGROUND OF THE INVENTION

1. Field of the Invention

The present invention generally relates to electrical connectors and more particularly to a coupler for selectively maintaining proximity between two or more banana plug connectors.

2. Description of the Prior Art

Single conductor banana plug connectors 10, 12, such as those shown in FIGS. 1 and 2, are commonly used to interconnect various electronic devices, test equipment, and professional audio speaker components. In many instances, pairs of banana plug connectors or plugs are used to mate with pairs of female connectors or jacks.

These jacks are typically spaced about three-quarters of an inch (¾") apart, which is measured from about the center of each jack. However, in some cases, the female connectors do not have this spacing.

If a pair of banana plug connectors 10, 12 are molded together with ¾" spacing or if the connectors are inserted into a conventional coupler 14, as shown in FIGS. 1 and 2, which typically also has ¾" spacing, the plugs will only be able to mate with jacks having the same spacing. This presents a problem that applies even if the female connectors vary only slightly from the standard ¾" spacing, which may be caused by, for instance, less than ideal tolerances during the manufacturing process.

Even when conventional couplers are not used, the individual wires coupled to the banana plug connectors present a sloppy appearance and have a tendency to create tangles and knots with other wires. In addition, when the plugs are not mated with the corresponding jacks, the plugs are prone to accidentally shorting to each other and various other conductive surfaces. This may cause serious damage to the device or equipment coupled to the plugs as well as the connectors, particularly in the case of, for instance, a high-power amplifier.

OBJECTS AND SUMMARY OF THE INVENTION

It is an object of the present invention to provide a coupler for banana plug connectors and coupled banana plug connectors that enable the banana plug connectors to mate with female connectors, which are not spaced at exactly ¾" apart, while the banana plug connectors remain coupled.

It is another object of the present invention to provide a coupler for banana plug connectors and coupled banana plug connectors in which the banana plug connectors may readily be uncoupled to enable the connectors to mate with female connectors that are not spaced ¾" apart while retaining the coupler on at least one of the banana plug connectors.

It is a further object of the present invention to provide a coupler for banana plug connectors and coupled banana plug connectors that prevent the wires coupled to the banana plug connectors from shorting, tangling, or knotting with each other and any conductive surfaces while the banana plug connectors are coupled.

It is still another object of the present invention to provide a coupler for banana plug connectors and coupled banana plug connectors that are simple and inexpensive to manufacture.

It is still a further object of the present invention to provide a coupler for banana plug connectors and coupled banana plug connectors that enable the banana plug connectors to assume a variety of rotational and linear orientations with respect to each other while remaining coupled.

A coupler formed in accordance with one form of the present invention, which incorporate some of the preferred features, includes a first portion and a second portion, which are preferably cylindrical. The first and second portions have apertures and longitudinal axes extending through the apertures.

The first and second portions are preferably coupled such that their longitudinal axes are substantially parallel to each other. The apertures are able to receive protrusions extending from the banana plug connectors, which are further adapted to receive additional banana plug connectors. The apertures may receive the protrusions in any of a plurality of rotational and/or linear orientations about the first and second longitudinal axes.

The coupler is preferably molded in a single unit from a flexible material, such as plastic, a polymer resin, or rubber. The coupler may also include a bridge, which is preferably coupled substantially perpendicularly to the longitudinal axes of the first and second portions. The apertures are preferably circular, but may also be substantially square, hexagonal, or octagonal.

Coupled banana plug connectors formed in accordance with another form of the present invention, which incorporate some of the preferred features, include a coupler as described above and two banana plug connectors.

The first banana plug connector includes a first protrusion and the second banana plug connector includes a second protrusion. The apertures in the banana plug connectors receive the protrusions, and the protrusions preferably include additional apertures to receive additional banana plug connectors. The apertures may receive the protrusions in any of a plurality of rotational and/or linear orientations about the longitudinal axes of the first and second portions.

These and other objects, features, and advantages of this invention will become apparent from the following detailed description of illustrative embodiments thereof, which is to be read in connection with the accompanying drawing.

DETAILED DESCRIPTION OF THE PREFERRED EMBODIMENTS

Figure 1:
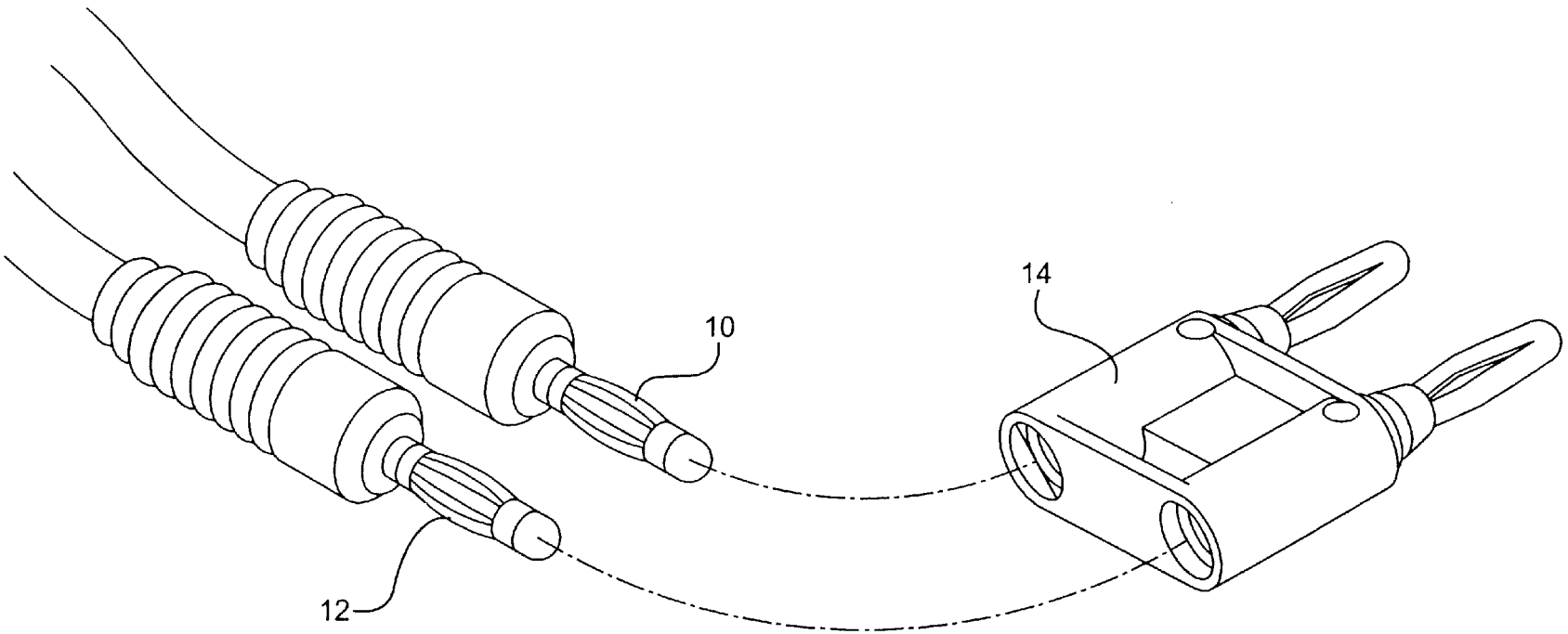
FIG. 1 PRIOR ART
FIG. 1 is an isometric, exploded view of a conventional pair of banana plug connectors and a conventional coupler for the banana plug connectors.
Figure 2:
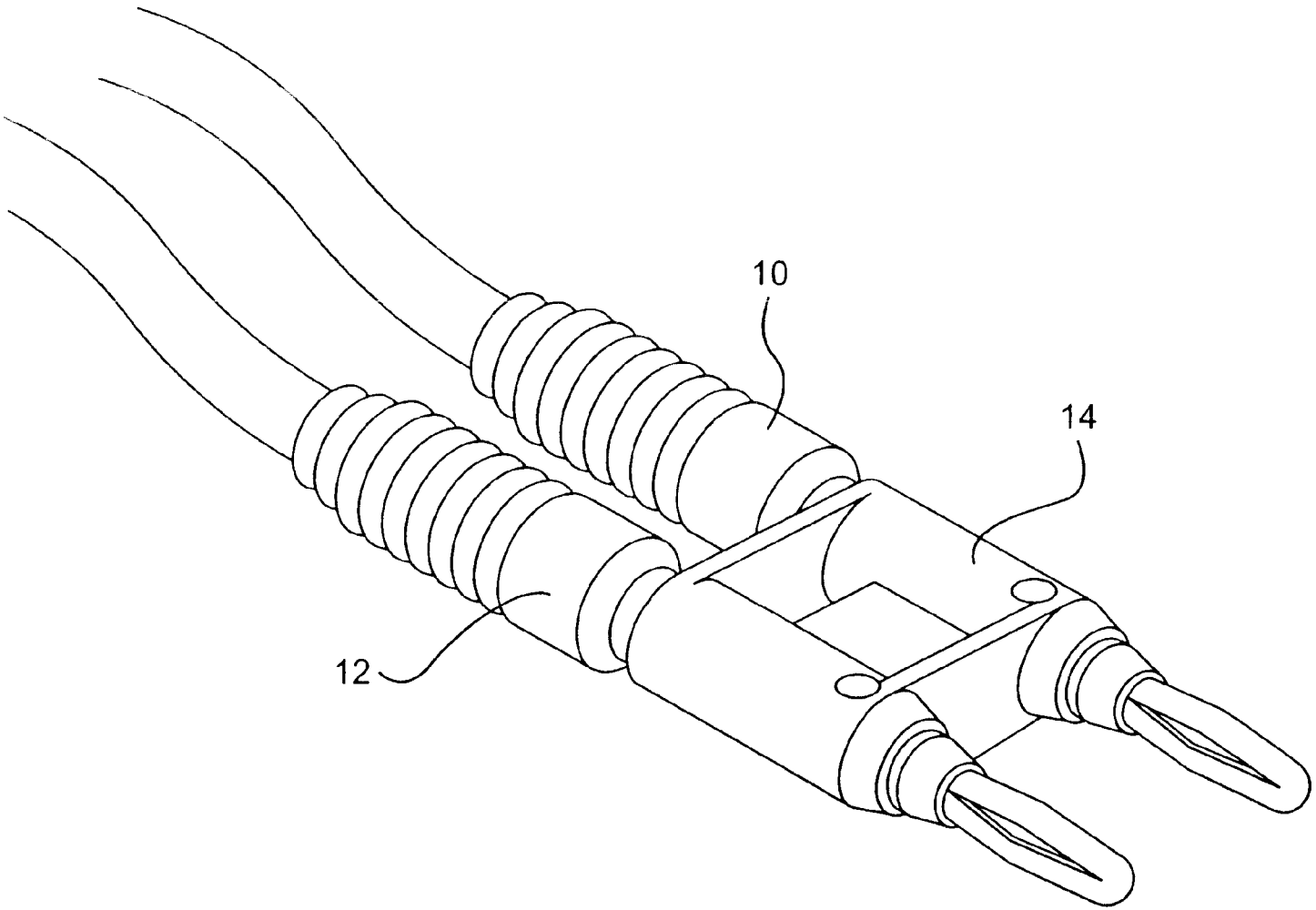
FIG. 2 PRIOR ART
FIG. 2 is an isometric, assembled view of the conventional connectors and coupler shown in FIG. 1.

Prior to referring to any one particular figure of the drawing, the coupler of the present invention will be generally described. It includes a first portion and a second portion. The first portion has a first longitudinal axis and a first aperture, which extends substantially parallel to the first longitudinal axis through the first portion.

The second portion has a second longitudinal axis and a second aperture, which extends substantially parallel to the second longitudinal axis through the second portion. The first and second portions are coupled such that the first and second longitudinal axes are substantially parallel to each other.

The first and second apertures are capable of engaging protrusions that extend from the banana plug connectors. The protrusions may also receive additional banana plug connectors even after the first and second apertures have received the protrusions.

The first and second apertures are able to receive the protrusions in a plurality of different rotational and/or linear orientations about the first and second longitudinal axes. If the apertures are substantially circular, as is preferable, the banana plug connectors may assume different rotational and/or linear orientations about the first and second longitudinal axes after the protrusions have been received by the first and second apertures, respectively.

Figure 3:
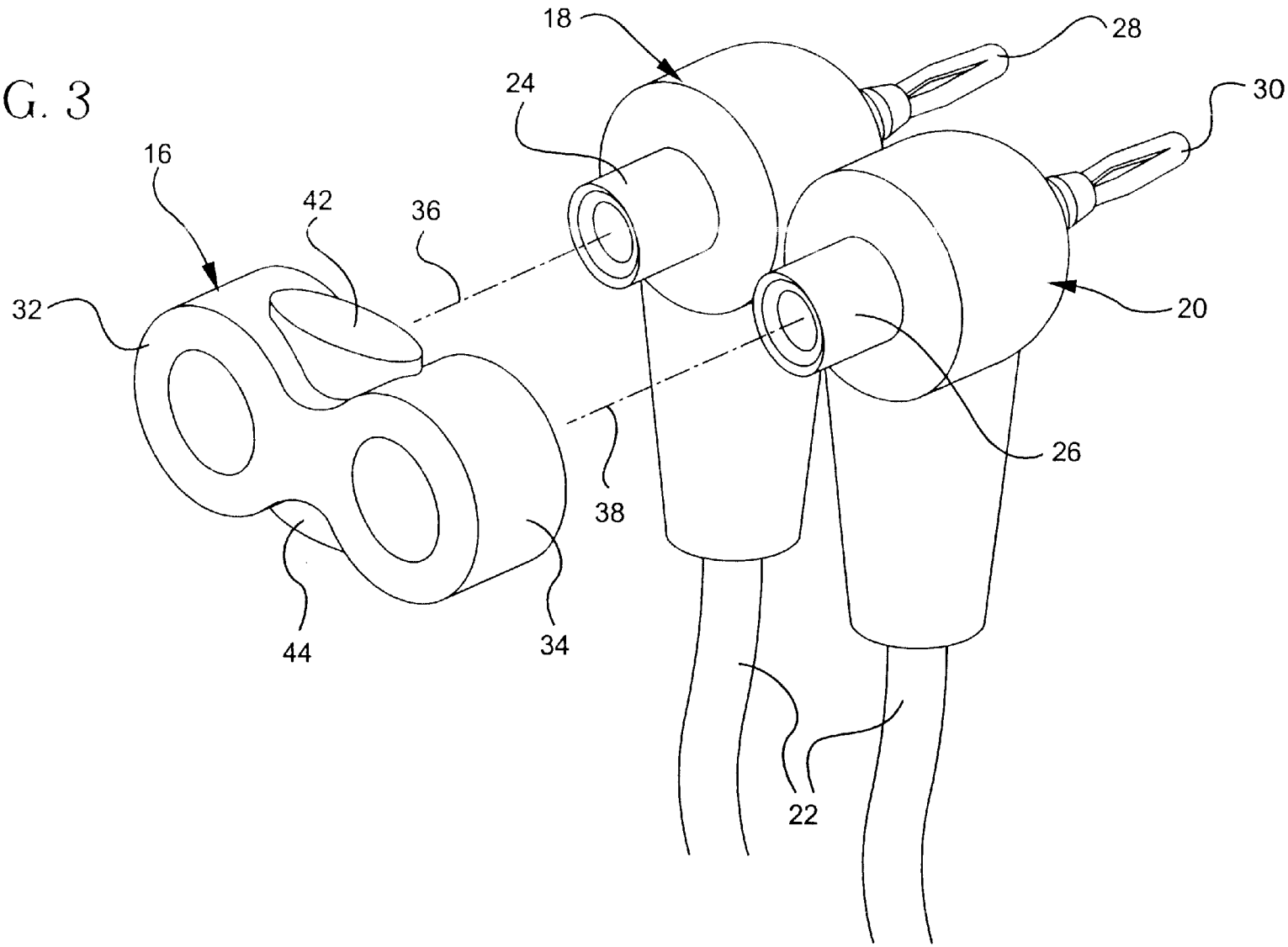
FIG. 3 is an isometric, exploded view of a pair of banana plug connectors and a coupler formed in accordance with the present invention.

FIG. 3 shows an exploded view of a coupler 16, which is formed in accordance with the present invention, and a pair of banana plug connectors 18, 20, which are coupled to wires, leads, or conductors 22. The banana plug connectors 18, 20 preferably also include protrusions 24, 26, respectively, which preferably extend from a rear face of the banana plug connector 18, 20. Terminal 28, 30 are preferably located on a face opposing that of the rear face of the connectors 18, 20, respectively.

In a preferred embodiment, the coupler 16 includes the first portion 32 and the second portion 34, which are preferably cylindrical. The first and second portions 18, 20 are preferably coupled together such that the longitudinal axes 36, 38, which extend through the apertures of each of the first and second portions 32, 34, respectively, are substantially parallel.

Figure 4:
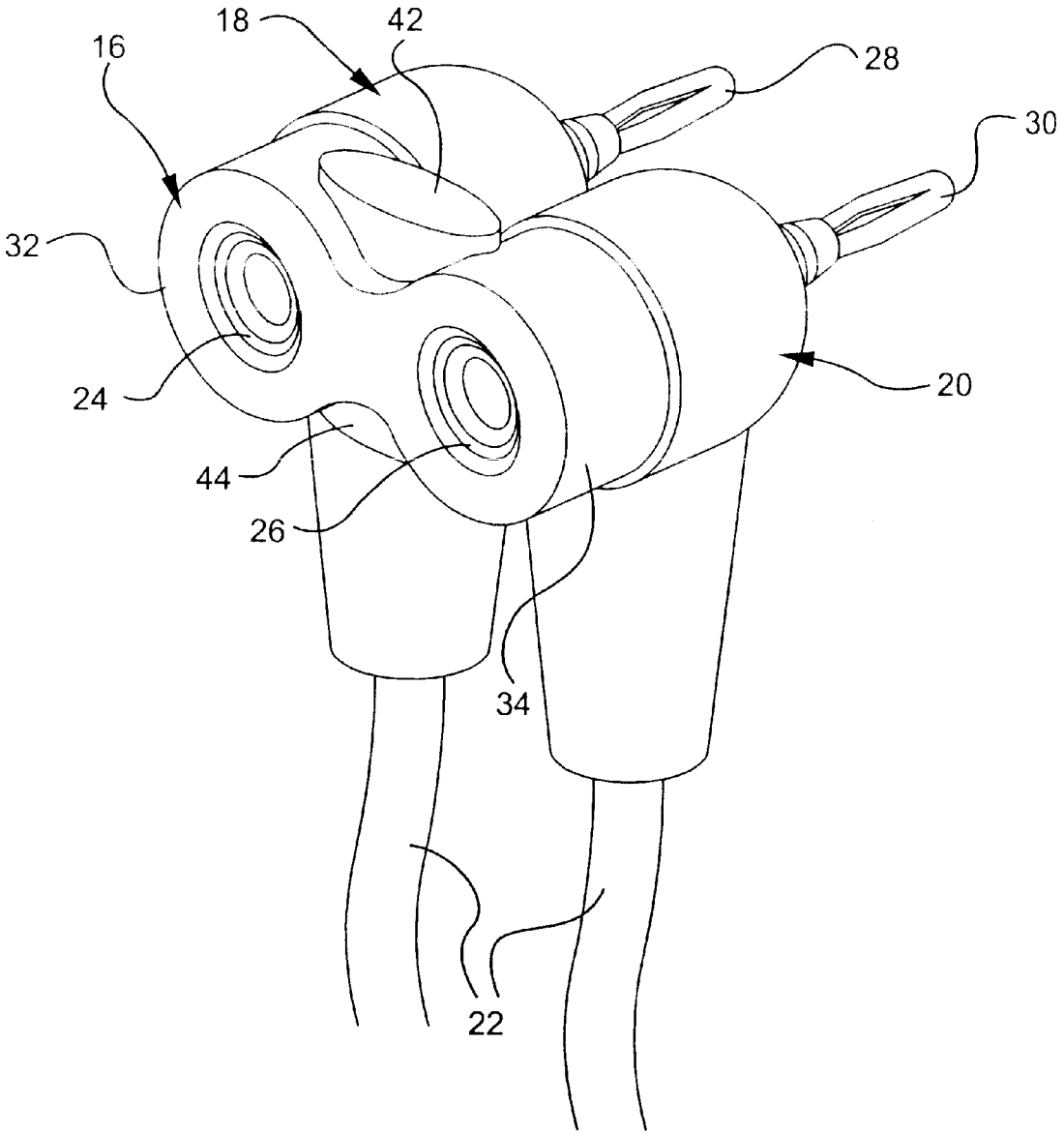
FIG. 4 is an isometric, assembled view of the pair of banana plug connectors and the coupler shown in FIG. 3.

The apertures preferably provide a frictional fit over and around the protrusions 24, 26, which extend from the rear faces of the first and second banana plug connectors 18, 20, respectively, as shown in FIG. 4. Once the coupler 16 has received the protrusions 24, 26, the frictional fit preferably retains the coupler 16 on the banana plug connectors 18, 20.

Figure 5:
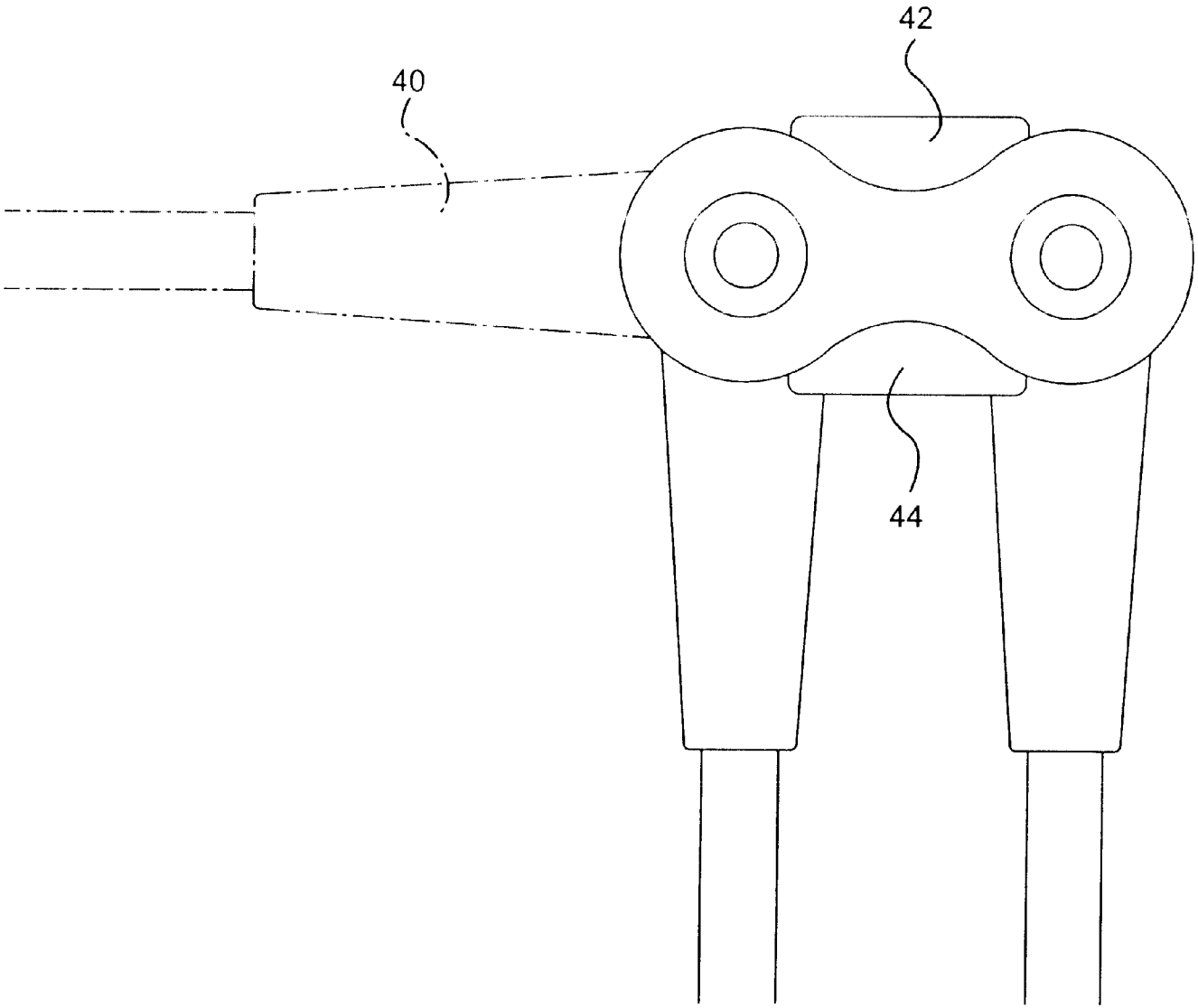
FIG. 5 is a rear view of the assembled connectors and coupler shown in FIG. 4, which also shows an alternative orientation of one of the connectors.

As is further shown in FIG. 5, the frictional fit between the coupler 16 and the protrusions 24, 26 enable the banana plug connectors 18, 20 to be rotated while being retained by the coupler 16, as shown by a phantom line 40 in FIG. 5. This enables the banana plug connectors 18, 20 to assume various rotational and/or linear orientations with respect to each other and their longitudinal axes while being retained by the coupler 16.

Figure 6:
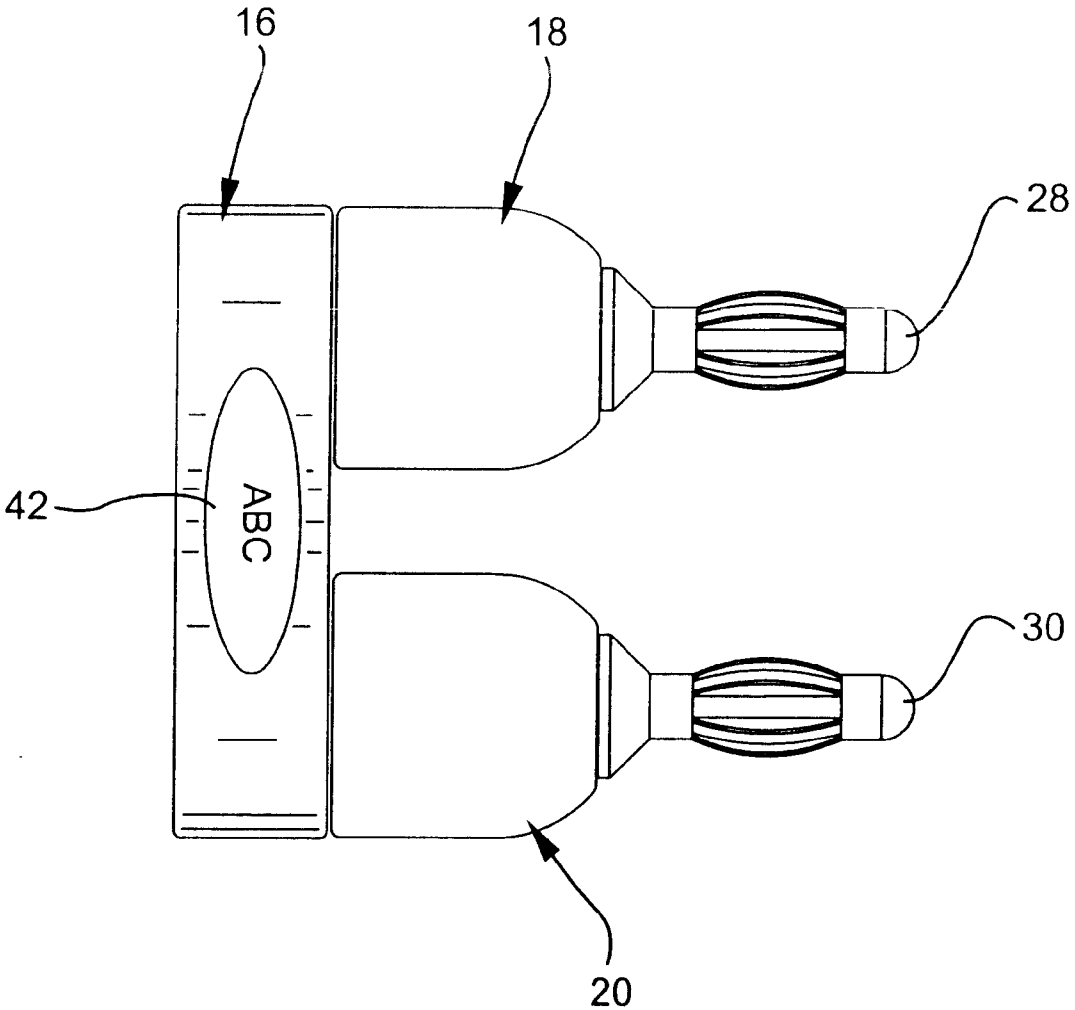
FIG. 6 is a top view of the assembled connectors and coupler shown in FIG. 4.

The coupler 16 also preferably includes a bridge 42, as shown in FIG. 6, which may advantageously be used as a flat surface for mounting, affixing, or positioning an identification label, logo, trademark, and the like. The bridge also provides additional rigidity to the coupler 16 to maintain the distance and isolation between banana plug connectors that are coupled thereby. In addition, such a bridge 42 may be placed on an underside of the coupler 16, as shown by the bridge 44 in FIGS. 3–5.

Figure 7C:
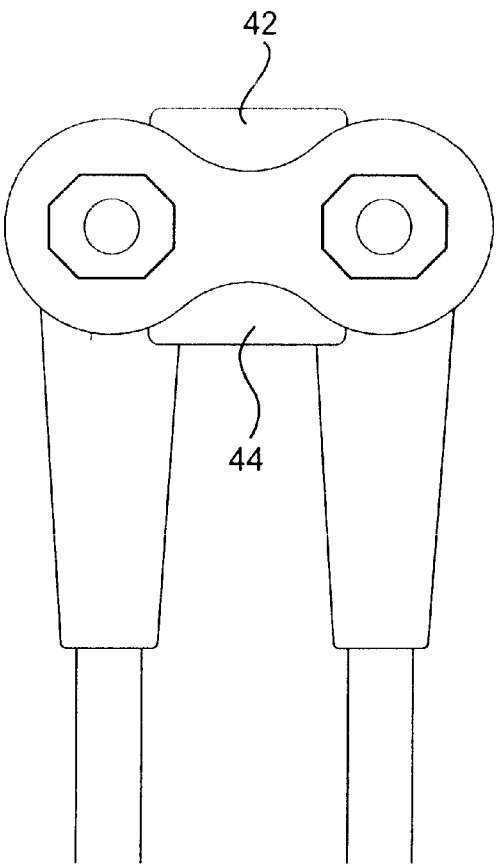
FIGS. 7*a*–7*c* are rear views of the assembled connectors and alternative embodiments of the coupler shown in FIG. 4.
Figure 7B:
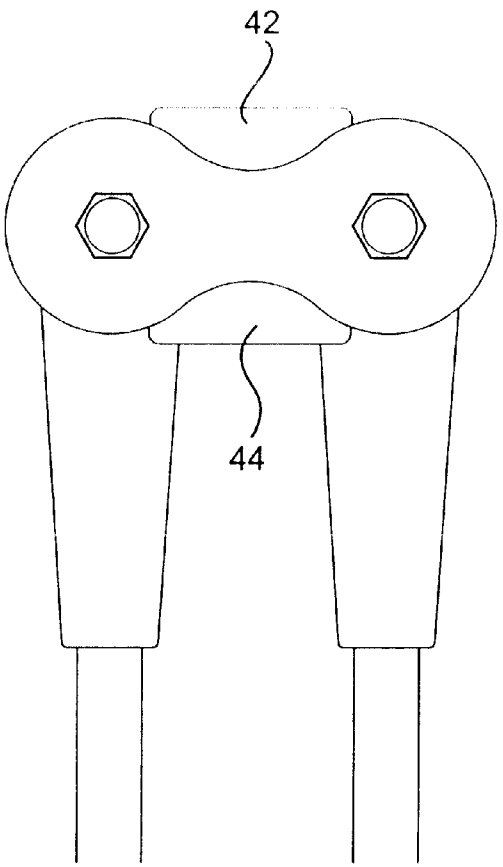
Figure 7A:
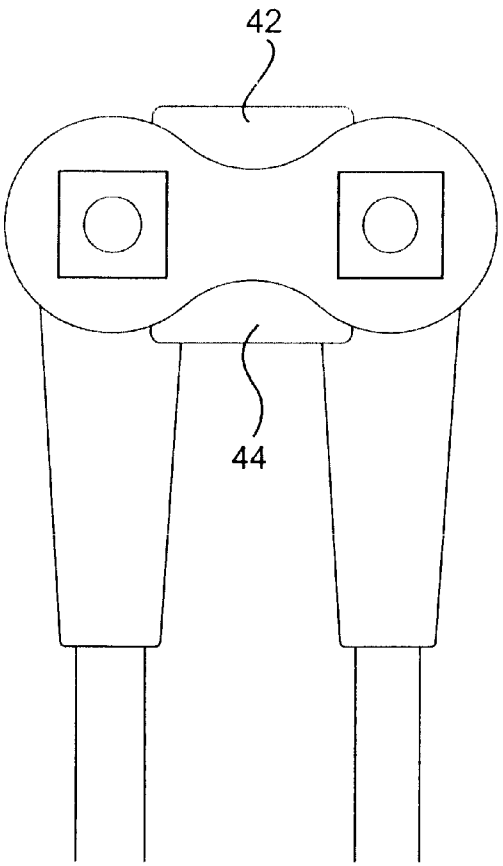

The apertures in the coupler 16 may alternatively be substantially square, as shown in FIG. 7*a*, substantially hexagonal, as shown in FIG. 7*b*, substantially octagonal, as shown in FIG. 7*c*, or any multi-sided shape. These embodiments of the coupler 16 may not readily permit the rotation of the banana plug connectors 18, 20 while engaged by the coupler 16, but do permit the connectors 18, 20 to be received in various rotational and/or linear orientations with respect to each other in accordance with the sides of the apertures.

The coupler 16 is preferably, non-conductive, flexible, and manufactured from plastic, polymer resin, rubber, and the like. The apertures of the coupler 16 are preferably space about three-quarters of an inch (¾") apart, but may be spaced at any other distance according to the parameters of the particular design. The coupler 16 is also preferably molded in a substantially single unit from the same material.

Thus, the coupler 16 prevents two or more banana plug connectors from accidentally shorting to each other when they are not plugged into corresponding female connectors. Obviously, if the device to which the banana plug connectors are being connected have female connectors mounted ¾" apart, the coupled banana plug connectors can be used easily, safely, and effectively with the coupler 16 engaged in and around the protrusions on the connectors.

However, if the jacks are spaced at an increment larger or smaller than ¾" apart, the coupler 16 may be slipped off one of the protrusions, rotated so that the coupler is not lost, and the individual banana plug connectors may be moved to any required position. In addition, the flexibility of the coupler 16 allows the user to mate the banana plug connectors with corresponding female connectors that are not spaced at precisely ¾" apart while the banana plug connectors are coupled.

Therefore, the coupler for banana plug connectors and coupled banana plug connectors enable banana plug connectors to be readily uncoupled, thereby enabling the banana plug connectors to mate with female connectors that are not spaced ¾" apart while retaining the coupler on at least one of the banana plug connectors. Further, the coupler and coupled banana plug connectors of the present invention prevent wires coupled to the banana plug connectors from shorting, tangling, or knotting with each other while the connectors are coupled. In addition, the present invention enables such connectors to assume a variety of rotational and/or linear orientations with respect to each other while remaining coupled.

Although illustrative embodiments of the present invention have been described herein with reference to the accompanying drawing, it is to be understood that the invention is not limited to those precise embodiments, and that various other changes and modifications may be effected therein by one skilled in the art without departing from the scope or spirit of the invention.

What is claimed is:

1. A flexible coupler selectively coupling together a pair of banana plug connectors, each of the pair of banana plug connectors including a male connector and a female connector, the flexible coupler comprising:

a first aperture selectively receiving a female connector of one of the pair of banana plug connectors; and a second aperture selectively receiving a female connector of the other of the pair of banana plug connectors, the first and second apertures being located side-by-side and spaced apart a predetermined distance, the first and second apertures being dimensioned to closely receive and selectively retain the female connectors of the pair of banana plug connectors, thereby selectively maintaining the female connectors and the male connectors of the pair of banana plug connectors a predetermined distance apart from each other.

2. A flexible coupler for a pair of banana plug connectors as defined by claim 1, wherein the coupler includes at least one of plastic, polymer resin, and rubber.

3. A flexible coupler for a pair of banana plug connectors as defined by claim 1, wherein the coupler is substantially bow tie-shaped.

4. A flexible coupler for a pair of banana plug connectors as defined by claim 1, wherein the first and second apertures are spaced about three-quarters of an inch (¾") apart.

5. A flexible coupler for a pair of banana plug connectors as defined by claim 1, wherein at least one of the first and second apertures is substantially circular.

6. A flexible coupler for a pair of banana plug connectors as defined by claim 1, wherein the coupler is formed as a single unit from substantially the same material.

7. A flexible coupler for a pair of banana plug connectors as defined by claim 1, wherein the coupler is molded.

8. A flexible coupler for a pair of banana plug connectors as defined by claim 1, wherein the coupler is adapted to enable the female connector to receive an additional male connector upon the first and second apertures receiving the female connectors.

9. A flexible coupler for a pair of banana plug connectors as defined by claim 1, which further comprises a bridge, the bridge coupling the first and second apertures.

10. A flexible coupler for a pair of banana plug connectors as defined by claim 9, which further comprises at least one of a label, logo, and trademark positioned on the bridge.

11. In combination, a pair of banana plug connectors, each of the pair of banana plug connectors including a male connector, a female connector coaxially located with the male connector, and at least one wire extending radially therefrom, the male connector being adapted for being received by a female connector of a first mating connector, and a flexible coupler, the flexible coupler including a first aperture and a second aperture, the first and second apertures being located side-by-side and spaced apart a predetermined distance, the first and second apertures being dimensioned to closely receive and selectively retain the female connectors of the pair of banana plugs, thereby selectively maintaining the female connectors and the male connectors of the pair of banana plug connectors a predetermined distance apart from each other.

12. A combination as defined by claim 11, wherein the coupler includes at least one of plastic, polymer resin, and rubber.

13. A combination as defined by claim 11, wherein the coupler is substantially bow tie-shaped.

14. A combination as defined by claim 11, wherein the first and second apertures are spaced about three-quarters of an inch (¾") apart.

15. A combination as defined by claim 11, wherein at least one of the first and second apertures is substantially circular.

16. A combination as defined by claim 11, wherein the coupler is formed as a single unit from substantially the same material.

17. A combination as defined by claim 11, wherein the coupler is molded.

18. A combination as defined by claim 11, wherein the female connector is adapted to receive an additional male connector upon the first aperture and the second aperture receiving the female connectors.

19. A combination as defined by claim 11, which further comprises a bridge, the bridge coupling the first and second apertures.

20. A combination as defined by claim 19, which further comprises at least one of a label, logo, and trademark positioned on the bridge.

* * * * *